US007543921B2

(12) United States Patent
Byun et al.

(10) Patent No.: US 7,543,921 B2
(45) Date of Patent: Jun. 9, 2009

(54) INK-JET PRINTING APPARATUS WITH FOAM REMOVING MEANS

(75) Inventors: Young Sang Byun, Goyang-si (KR); Young Phil Bang, Seoul (KR)

(73) Assignee: LG Display Co., Ltd., Seoul (KR)

( * ) Notice: Subject to any disclaimer, the term of this patent is extended or adjusted under 35 U.S.C. 154(b) by 481 days.

(21) Appl. No.: 11/321,737

(22) Filed: Dec. 30, 2005

(65) Prior Publication Data

US 2006/0284943 A1 Dec. 21, 2006

(30) Foreign Application Priority Data

Jun. 20, 2005 (KR) ..... 10-2005-0053143

(51) Int. Cl.
*B41J 2/17* (2006.01)
*B41J 2/05* (2006.01)
*B41J 2/14* (2006.01)

(52) U.S. Cl. ..... 347/84; 347/65; 347/47

(58) Field of Classification Search ..... 347/70, 347/23, 171, 85, 47, 56, 65, 67, 71, 75, 84; 106/31.26

See application file for complete search history.

(56) References Cited

U.S. PATENT DOCUMENTS

| | | | | |
|---|---|---|---|---|
| 5,868,822 | A * | 2/1999 | Yui et al. | 106/31.26 |
| 6,027,208 | A * | 2/2000 | Amano | 347/70 |
| 6,513,902 | B1 * | 2/2003 | Amano et al. | 347/23 |
| 7,061,515 | B2 * | 6/2006 | Cummins et al. | 347/171 |
| 7,325,908 | B2 * | 2/2008 | Katoh et al. | 347/85 |

FOREIGN PATENT DOCUMENTS

JP 55128463 A * 10/1980

* cited by examiner

*Primary Examiner*—Stephen D Meier
*Assistant Examiner*—Rene Garcia, Jr.
(74) *Attorney, Agent, or Firm*—McKenna Long & Aldridge LLP

(57) ABSTRACT

An ink-jet printing apparatus that uniformly coats an alignment layer of an LCD device is provided. The ink-jet printing apparatus includes a head where the head has a head body and a supply pipe disposed inside the head body. The supply pipe allows the passage of a material through the head. The head also includes a nozzle and a foam removing means. The nozzle is in fluid communication with a portion of the supply pipe which discharges the material. The foam removing means is disposed in the nozzle and dissipates foam in the material.

8 Claims, 3 Drawing Sheets

INK-JET PRINTING APPARATUS WITH FOAM REMOVING MEANS

This application claims the benefit of the Korean Patent Application No. P2005-0053143, filed on Jun. 20, 2005, which is hereby incorporated by reference as if fully set forth herein.

BACKGROUND OF THE INVENTION

1. Field of the Invention

The present invention relates to an apparatus for manufacturing an LCD device, and more particularly, to an ink-jet printing apparatus which coats an alignment layer or the like on an LCD device.

2. Discussion of the Related Art

Ultra-thin flat type display devices have many applications. These display devices include a display screen having a thickness of several centimeters. Among the ultra-thin flat type display panels, liquid crystal display (LCD) devices have been used in a number of applications, including notebook computers, monitors, spacecraft, aircraft, etc.

Generally, a LCD device has a lower substrate, an upper substrate, and a liquid crystal layer formed in a gap between the lower substrate and the upper substrate. Typically, when a voltage is applied, the alignment of the liquid crystal layer changes. Thus, driving the liquid crystal layer controls light transmittance of the LCD device, thereby displaying images.

However, if the arrangement of the liquid crystal molecules becomes disordered when the voltage is applied, it is impossible to obtain a desired image. Thus, alignment layers should be formed on the lower and upper substrates in order to initially align the liquid crystal layer.

Generally, a method for forming the alignment layer is classified into a rubbing alignment method or a photo alignment method.

In the rubbing alignment method, an alignment material is thinly coated on a substrate. After coating, a rubbing roll having a rubbing cloth wound thereon rolls on the coated alignment material.

In the photo alignment method, an alignment material is thinly coated on a substrate. After coating, a polarized or non-polarized UV ray is applied to the coated alignment material.

The alignment material should be uniformly coated on the substrate such that the alignment layer is arranged in one direction when applying either the rubbing alignment method or the photo alignment method.

Hereinafter, a related art method for coating an alignment material on a substrate will be described with reference to the accompanying drawings.

FIG. 1 is a cross sectional view showing a method for coating an alignment layer with a related art roll printing apparatus.

The related art roll printing apparatus is provided with a substrate stage 12 for supporting a substrate 10, a dispenser 14 for supplying an alignment material, a doctor roll 16, an anilox roll 18, and a printing roll 20. The doctor roll 16 engages with the anilox roll 18 and the anilox roll 18 engages with the printing roll 20.

The printing roll 20 has a rubber plate 22 attached thereto suitable for printing a desired pattern of the alignment material.

A method for coating the alignment layer with the above roll printing apparatus will be described as follows. First, the alignment material 15 of the dispenser 14 is supplied between the doctor roll 16 and the anilox roll 18. In this case, because the doctor roll 16, the anilox roll 18, and the printing roll 20 are engaged with one another, and revolve as indicated by the directional arrows, the alignment material 15, supplied between the doctor roll 16 and the anilox roll 18, is uniformly coated on the rubber plate 22 on the printing roll 20 through the anilox roll 18.

In the meantime, the substrate 10 is placed on the substrate stage 12, and the substrate stage 12 moves in a predetermined direction below the printing roll 20. When the substrate stage 12 moves, the substrate 10 placed on the substrate stage 12 contacts the rubber plate 22 of the printing roll 20. Thus, the alignment material coated on the rubber plate 22 is printed on the substrate 10, whereby the alignment material is coated on the substrate 10.

However, the method for coating the alignment material with the roll printing apparatus according to the related art has the following disadvantages.

First, the sizes of the three rolls must be changed when a model size of the LCD device changes. Second, for applications having a larger substrate which require a larger printing roll, it becomes more difficult to evenly coat alignment material on the entire surface of the substrate. Third, use of the printing roll device wastes a fair amount of alignment material, thereby increasing production costs associated with coating a substrate using the related art roll printing apparatus.

SUMMARY OF THE INVENTION

Accordingly, the present invention is directed to an ink-jet printing apparatus that substantially obviates one or more problems due to limitations and disadvantages of the related art.

An advantage of the present invention is to provide an ink-jet printing apparatus which uniformly coats an alignment material on a substrate regardless of model size of the substrate thereby reducing costs associated with fabricating the display device.

Another advantage of the present invention is to provide an ink-jet printing apparatus which coats an alignment material on a substrate while removing foam from the alignment material.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these advantages and in accordance with the purpose of the invention, as embodied and broadly described herein, an ink-jet printing apparatus is disclosed. The ink-jet printing apparatus comprises a head which includes a head body and a supply pipe disposed inside the head body where the supply pipe is configured to allow passage of a material. The head also includes a nozzle in fluid communication with a portion of the supply pipe which discharges the material and a foam removing means disposed in the nozzle. The foam removing means is configured to dissipate foam in the material.

To overcome problems of a related art ink-jet printing apparatus, the ink-jet printing apparatus according to the present invention coats an alignment material through the nozzle.

In this embodiment, the foam removing means protrudes toward the supply pipe from inside the nozzle. Also, the foam removing means connects with the head body with bridges, which extend from the head body.

The ink-jet printing apparatus according to the present invention also has the foam removing means. Thus, even though the alignment material may have foam, the foam removing means removes any foam from the alignment material, thereby allowing smooth discharge of the alignment material.

The head of the ink-jet printing apparatus according to the present invention is used in forming an alignment layer. However, the head may be used to form other layers of an LCD device. Additionally, the head may be used to form various layers for other kinds of display devices. Accordingly, the predetermined material may be formed of various materials as well as the alignment material.

The head of the ink-jet printing apparatus according to the present invention includes a discharger which discharges the material flowing in the supply pipe through the nozzle. The discharger includes a piezoelectric device opposite the nozzle where the supply pipe is disposed between the piezoelectric device and the nozzle, and a voltage application part operatively coupled with the piezoelectric device for applying a voltage. However, the discharger is not limited to this structure.

The piezoelectric device has a piezoelectric phenomenon, in which positive and negative charges are generated at opposite sides of a certain kind of crystalline plate. The generated charges are proportional to an external force applied to the crystalline plate in a fixed direction. The piezoelectric phenomenon was discovered in 1880 by brothers Jacque Curie and Pierre Curie (1859~1906). Thereafter, it was discovered that, though piezoelectricity from one crystalline plate is feeble, if a plurality of crystalline plates are put together with a sheet of metal foil placed therebetween, a quantity of the piezoelectricity significantly increased. Furthermore, a crystalline plate has a natural frequency, and when an elastic vibration and an electric vibration resonate, an intense vibration is generated in association with the piezoelectricity.

Upon discovery of the piezoelectric phenomenon, piezoelectric devices have been developed. Piezoelectric devices are formed of quartz, tourmaline, Rochelle salt, etc. Recently, artificial crystals, such as barium titanate, ammonium dihydrogen phosphate, and ethylencediamine tartarate, have also been used as a material of the piezoelectric device due to their favorable piezoelectric properties.

Also, a plurality of nozzles may be formed in the heads. Here, a plurality of supply pipes, foam removing means and dischargers may also be formed depending on the number of nozzles.

Also, the plurality of heads may be formed in accordance with the size of substrate.

In addition to the heads, the ink jet printing apparatus may have a substrate stage, which supports a substrate, a supply tank which supplies the material, and a pipe that couples the supply tank with the head. In this embodiment, both the substrate stage and the head are movable.

In accordance with a further embodiment of the present invention, an ink jet printing apparatus head is disclosed. The ink jet printing apparatus head includes a head body, a supply pipe disposed within the head and a discharger disposed within the head body. The ink jet printing apparatus head further includes a nozzle opposite the discharger and a foam removing means. The discharger is configured to discharge material through the nozzle. Here, the foam removing means is configured to dissipate foam in the material.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to an embodiment of the present invention, example of which is illustrated in the accompanying drawings. It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents. Wherever possible, the same reference numbers will be used throughout the drawings to refer to the same or like parts.

Hereinafter, an ink-jet printing apparatus according to the present invention will be described with reference to the accompanying drawings.

Figure 1:
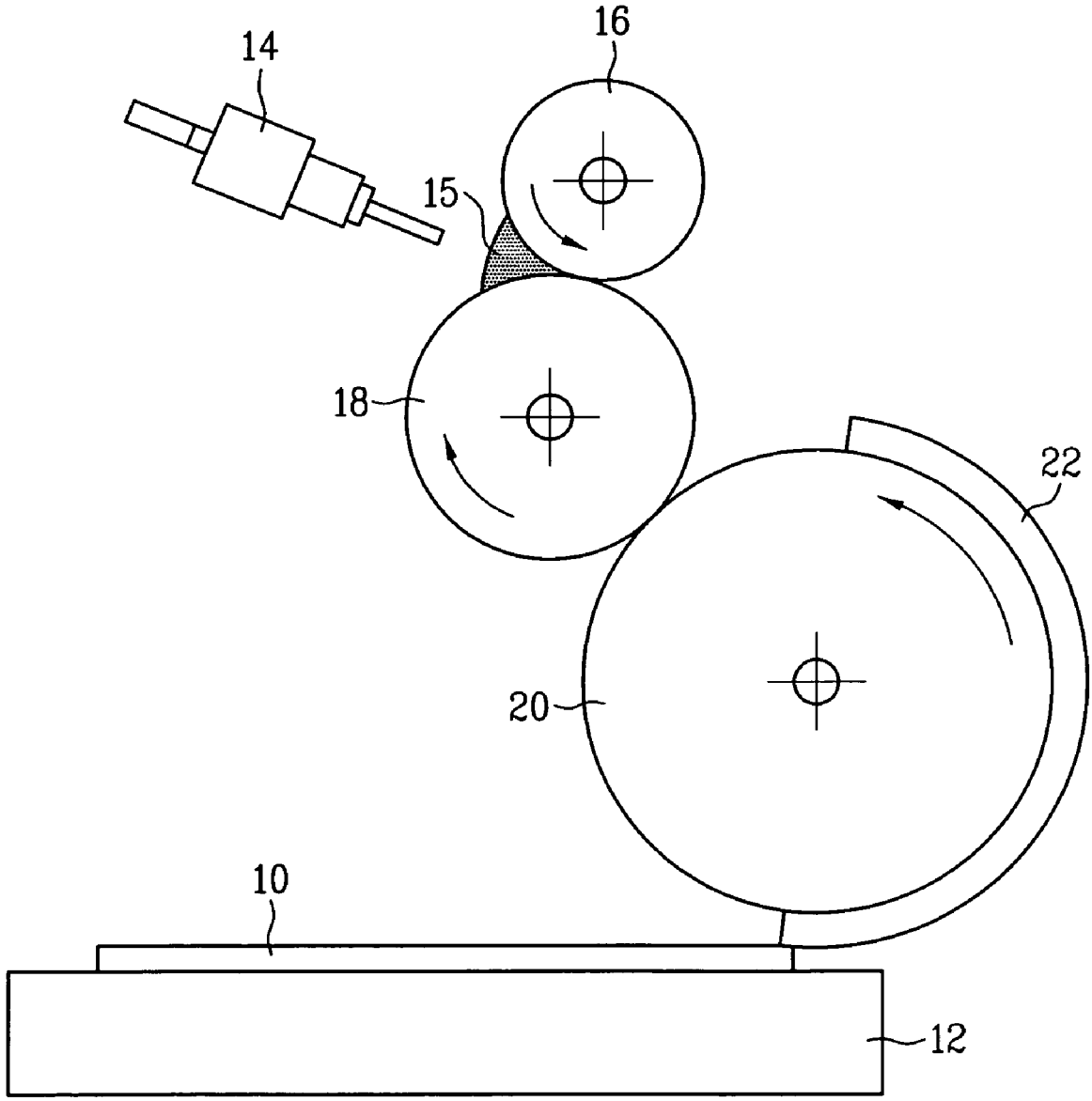
FIG. 1 Related Art
FIG. 1 shows a method of coating an alignment layer with a roll printing apparatus according to the related art.
Figure 2:
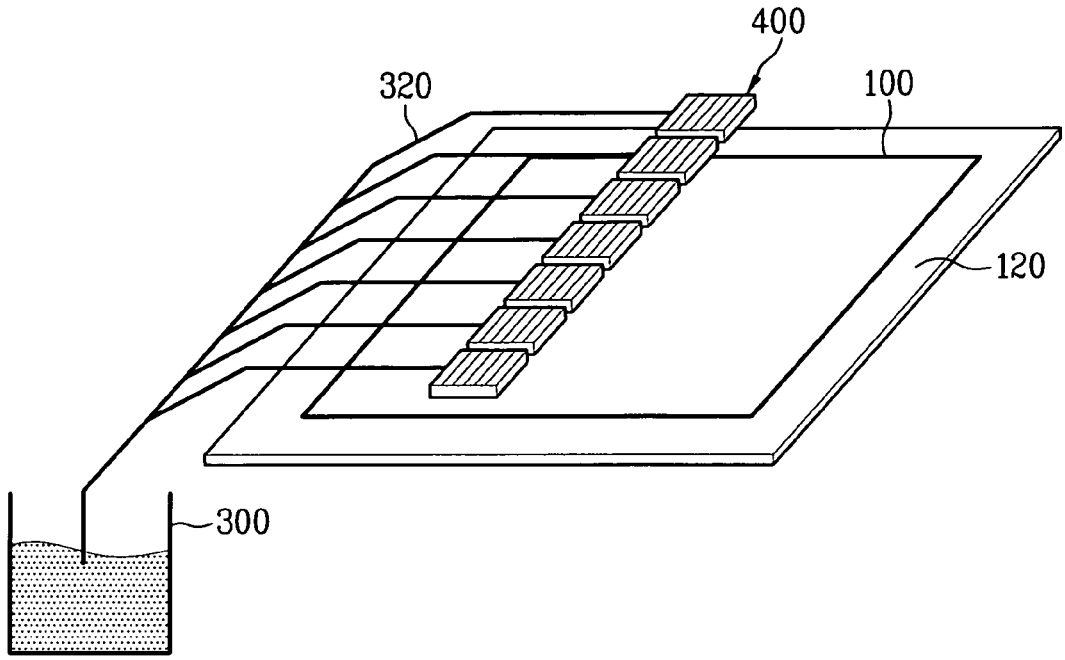
FIG. 2 is a perspective view of an ink-jet printing apparatus in accordance with the present invention.
Figure 3:
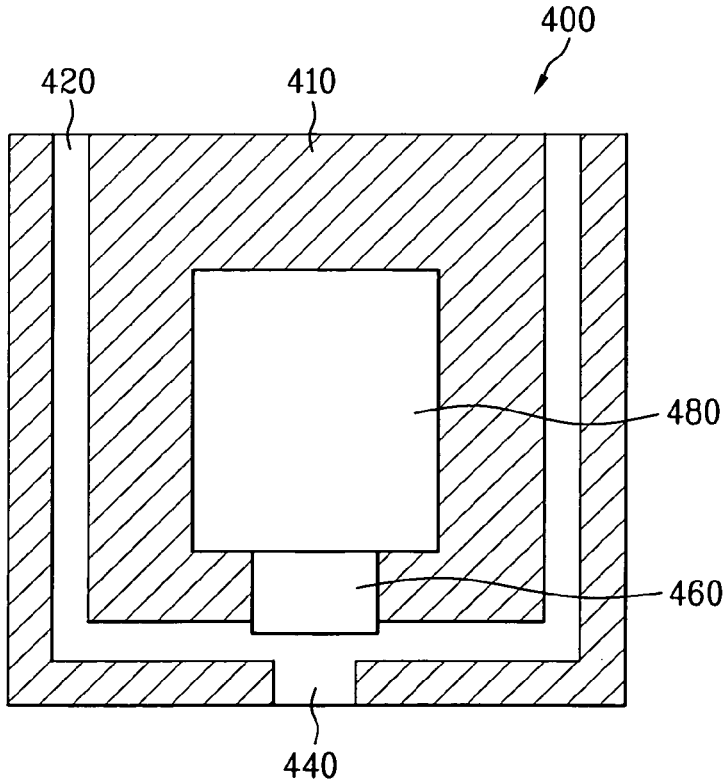
FIG. 3 is a cross sectional view of a head of an ink-jet printing apparatus in accordance with an embodiment of the present invention.
Figure 4:
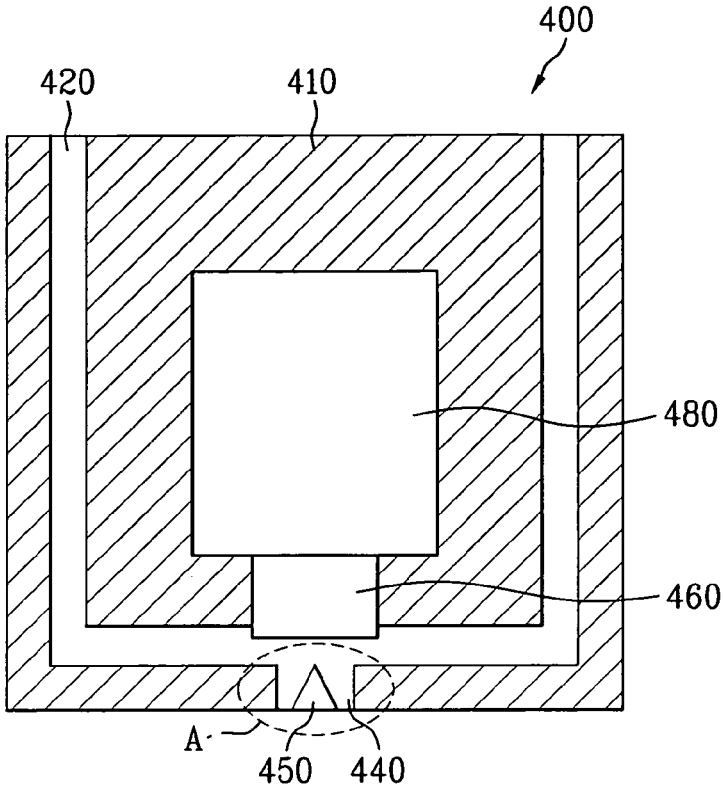
FIG. 4 is a cross sectional view of a head of an ink-jet printing apparatus in accordance with an embodiment of the present invention.
Figure 5:
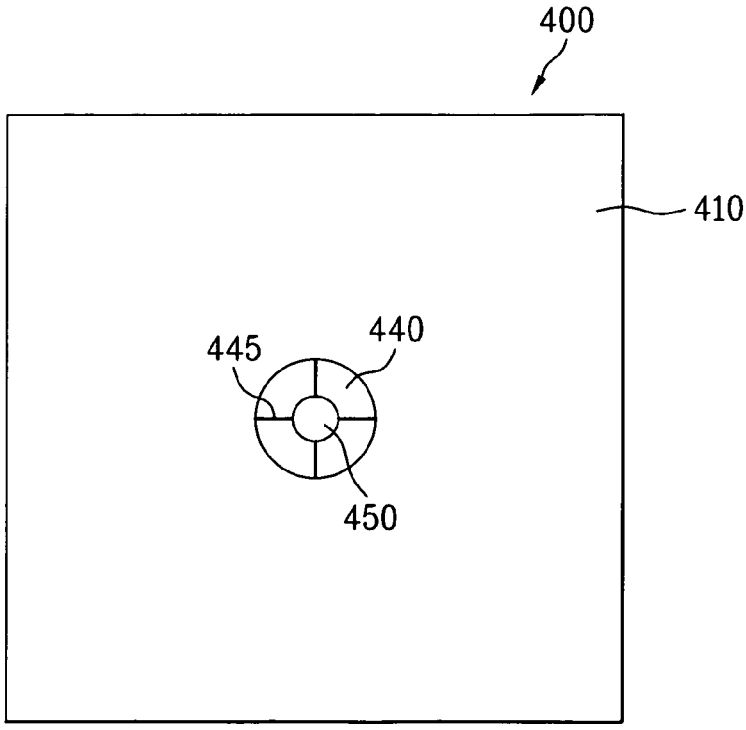
FIG. 5 is a bottom view which depicts call-out 'A' of FIG. 4.

FIG. 2 is a perspective view showing an ink-jet printing apparatus according to the present invention. FIG. 3 is a cross sectional view showing a head of an ink-jet printing apparatus according to a first embodiment of the present invention. FIG. 4 is a cross sectional view showing a head of an ink-jet printing apparatus according to a second embodiment of the present invention. FIG. 5 is a bottom view which depicts call-out 'A' of FIG. 4.

As shown in FIG. 2, the ink-jet printing apparatus according to the present invention has a substrate stage 120, a supply tank 300, a plurality of heads 400, and a plurality of pipes 320. Each of the pipes 320 connects the supply tank 300 with each of the heads 400.

In one embodiment, the substrate stage 120, which supports a substrate 100, moves in a predetermined direction.

The supply tank 300 holds an alignment material where the alignment material is supplied to each of the heads 400 through the pipes 320.

In accordance with an embodiment of the present invention, the substrate size dictates the number of heads 400 used in the ink-jet printing apparatus. More specifically, the larger the size of the substrate, the greater the number of heads 400. In this embodiment, the heads 400 may be movable in a predetermined direction.

A structure of the head 400 is explained with reference to FIGS. 3 to 5.

In accordance with embodiments of the present invention, a plurality of nozzles may be formed in each of the heads 400. However, In FIGS. 3 to 5, only one nozzle is shown.

FIG. 3 is a cross sectional view of a head of an ink-jet printing apparatus according to an embodiment of the present invention. FIGS. 4 and 5 are cross sectional views of a head of an ink-jet printing apparatus according to a further embodiment of the present invention.

As shown in FIG. 3, the head 400 includes a head body 410, a supply pipe 420, a nozzle 440, a piezoelectric device 460, and a voltage applicator 480.

The supply pipe 420 allows for the passage of a predetermined material, such as an alignment material, into the head 400.

The nozzle 440 connects with a predetermined portion of the supply pipe 420. Thus, the predetermined material discharges from the head 400 through the nozzle 440.

The piezoelectric device 460 is disposed opposite the nozzle 440 such that the supply pipe 420 is interposed between the piezoelectric device 460 and the nozzle 440. When the voltage applicator 480 applies a voltage to the piezoelectric device 460, the piezoelectric device 460 deforms, thereby squeezing the supply pipe 420. When the piezoelectric device 460 squeezes the supply pipe 420, the predetermined material discharges from the head 400 through the nozzle 440. Accordingly, the piezoelectric device 460 and the voltage applicator 480 function as a discharger in discharging the predetermined material through the nozzle 440.

The voltage applicator 480, which applies the voltage to the piezoelectric device 460, is connected to the piezoelectric device 460.

A method for coating an alignment layer with the above ink-jet printing apparatus having the head 400 according to an embodiment of the present invention will be described as follows.

First, as shown in FIG. 2 and previously discussed, the supply tank 300 holds the alignment material. When a gas, such as nitrogen, is provided to the supply tank 300, an internal pressure of the supply tank 300 increases. The pressure increase causes the alignment material of the supply tank 300 to flow through the pipes 320 and into the plurality of heads 400.

The alignment material supplied to the heads 400 then discharges through the nozzles 440 of the heads 400. After discharge, the alignment material is coated on the substrate 100 placed on the substrate stage 120 below the heads 400.

In this embodiment, either one of the heads 400 or the substrate stage 120 may move in a predetermined direction such that the alignment material coats the entire surface of the substrate 100.

The alignment material discharged through the nozzles 440 of the heads 400 will be explained in greater detail with reference to FIG. 3. First, each of the pipes 320 is connected with the supply pipe 420 in each of the heads 400, such that the alignment material supplied through the pipe 320 flows through the supply pipe 420 of the head 400.

When the voltage applicator 480 applies the voltage to the piezoelectric device 460, the piezoelectric device 460 physically deforms. Thus, the flow passage of the supply pipe 420 is squeezed such that the alignment material is discharged through the nozzle 440.

In the ink-jet printing apparatus according to the present invention, the alignment material is coated on the substrate with the plurality of heads 400 having the nozzles 440. When voltage is selectively applied to the piezoelectric device 460, the alignment material is selectively discharged through the nozzles 440. Thus, when a model of an LCD device changes thereby changing the substrate size, the amount of alignment material coated on the substrate may be adjusted accordingly, thereby minimizing the amount of alignment material wasted.

Hereinafter, a head of an ink-jet printing apparatus in accordance with a further embodiment of the present invention will be described.

As shown in FIG. 4, the head 400 according to the second embodiment of the present invention includes the head body 410, the supply pipe 420, the nozzle 440, the piezoelectric device 460, the voltage applicator 480, and a foam removing means or foam removing pin 450.

The supply pipe 420, the nozzle 440, the piezoelectric device 460, and the voltage applicator 480 have a similar structure as described earlier in the embodiment discussed with reference to FIG. 3. Thus, detailed explanation will be omitted.

As foam may form in the alignment material. While being applied, the foam removing pin 450 protrudes from the nozzle 440 toward the supply pipe 420. The foam removing pin 450 dissipates foam which may be present in the alignment material. As shown in FIG. 5, four bridges 445 which extend from the head body 410 couple the foam removing pin 450 with the head body 410. It should be noted that additional bridges may also be provided. Furthermore, fewer bridges may also be used, as necessary.

The supply tank 300 supplies alignment material to the heads 400 with the pipes 320. The alignment material is coated on the substrate 100 placed on the substrate stage 120 through the nozzles 440 of the heads 400. In this embodiment, even if the alignment material includes foam therein, the foam removing pin 450 dissipates the foam therefrom. As a result, the alignment material is more smoothly discharged.

As mentioned above, the ink-jet printing apparatus according to the present invention has the following advantages.

In the ink-jet printing apparatus according to the present invention, the plurality of heads including the nozzles are provided, whereby the alignment material is selectively supplied to the substrate through the nozzles. Even though the model size of the LCD device is changed, it is possible to uniformly coat the alignment material on the substrate, and to minimize the waste of alignment material.

In addition, the foam removing pin is provided to the nozzle in the ink-jet printing apparatus according to the present invention. Thus, even though the alignment material includes foam therein, it is possible to smoothly discharge the alignment material.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An ink-jet printing apparatus comprising:

a substrate stage that supports a substrate;

a supply tank that supplies a material;

a plurality of heads, each head that includes:

a head body;

a supply pipe disposed inside the head body, the supply pipe configured to allow passage of the material;

a nozzle in fluid communication with a portion of the supply pipe where the material discharges through the nozzle; and a foam removing means disposed in the nozzle for dissipating foam in the material, wherein the foam removing means includes a pin protruding toward the supply pipe from an inside of the nozzle; and a pipe that couples the supply tank with the head.

2. The ink-jet printing apparatus of claim 1, the head body comprising:

a bridge extending therefrom, wherein the bridge couples with the pin.

3. The ink-jet printing apparatus of claim 1, wherein the head includes a discharger which discharges the material flowing through the supply pipe from the head through the nozzle.

4. The ink-jet printing apparatus of claim 3, wherein the discharger comprises:

a piezoelectric device disposed in the head opposite the nozzle; and a voltage applicator operatively coupled with the piezoelectric device, the voltage applicator applying a voltage thereto, wherein the supply pipe is interposed between the piezoelectric device and the nozzle.

5. The ink-jet printing apparatus of claim 1, wherein the head body includes a plurality of supply pipes, a plurality of nozzles and a plurality of foam removing means.

6. The ink-jet printing apparatus of claim 1, wherein the substrate stage or the heads move.

7. An ink jet printing apparatus head comprising:

a head body;

a supply pipe disposed within the head;

a discharger disposed within the head body;

a nozzle opposite the discharger, wherein the discharger is configured to discharge material through the nozzle;

foam removing means for dissipating foam in the material, wherein the foam removing means includes a pin which protrudes toward the supply pipe from an inside of the nozzle; and a bridge extending from the head body, wherein the bridge couples with the pin.

8. The ink-jet printing apparatus head of claim 7, wherein the discharger comprises:

a piezoelectric device; and a voltage applicator operatively coupled with the piezoelectric device, wherein the voltage applicator applies a voltage to the piezoelectric device, thereby deforming the piezoelectric device such that the discharger discharges the material through the nozzle.

* * * * *